US007849538B1

(12) United States Patent
Edgerton

(10) Patent No.: US 7,849,538 B1
(45) Date of Patent: Dec. 14, 2010

(54) HEIGHT ADJUSTABLE APPARATUS

(75) Inventor: John Edgerton, Omro, WI (US)

(73) Assignee: GF Health Products, Inc., Atlanta, GA (US)

( * ) Notice: Subject to any disclaimer, the term of this patent is extended or adjusted under 35 U.S.C. 154(b) by 385 days.

(21) Appl. No.: 12/005,467

(22) Filed: Dec. 26, 2007

Related U.S. Application Data

(63) Continuation-in-part of application No. 11/173,491, filed on Jun. 30, 2005, now Pat. No. 7,421,748.

(60) Provisional application No. 60/877,248, filed on Dec. 26, 2006.

(51) Int. Cl.
*A47B 7/00* (2006.01)

(52) U.S. Cl. ..... 5/611; 5/11

(58) Field of Classification Search ..... 5/11, 5/611, 86.1; 108/147, 144.11, 145; 254/418, 254/2 C, 93 I, 123; 296/20
See application file for complete search history.

(56) References Cited

U.S. PATENT DOCUMENTS

| | | | | |
|---|---|---|---|---|
| 3,003,159 | A | 10/1961 | Hebert et al. | |
| 4,062,075 | A | 12/1977 | Stern et al. | |
| 5,303,437 | A | 4/1994 | Hung | |
| 5,544,375 | A | 8/1996 | Urness et al. | |
| 5,720,059 | A * | 2/1998 | Allevato et al. | 5/610 |
| 6,161,236 | A * | 12/2000 | Carroll | 5/618 |
| 6,230,344 | B1 * | 5/2001 | Thompson et al. | 5/611 |
| 6,363,556 | B1 | 4/2002 | Krauska et al. | |
| 6,405,393 | B2 | 6/2002 | Megown | |
| 6,505,362 | B1 * | 1/2003 | Scipio | 5/118 |
| 6,851,144 | B2 | 2/2005 | Wang | |
| 6,868,567 | B2 | 3/2005 | Edgerton | |
| 7,013,510 | B1 * | 3/2006 | Johnson | 5/611 |
| 2002/0066142 | A1 | 6/2002 | Osborne et al. | |
| 2006/0021143 | A1 | 2/2006 | Lemire | |
| 2006/0026762 | A1 | 2/2006 | Hornbach et al. | |
| 2006/0123545 | A1 | 6/2006 | Johnson | |

* cited by examiner

*Primary Examiner*—Michael Trettel
*Assistant Examiner*—William Kelleher
(74) *Attorney, Agent, or Firm*—Brannen Law Office, LLC

(57) ABSTRACT

The present invention has a deck and a mid-frame, connected by first and second levers. An arm of the first lever has an interface. These levers are connected with a drag link. An actuator is pivotally and movably connected to the interface and pivotally connected to the drag link. The location of the actuator relative the interface is controlled with a control arm. The deck, mid-frame and first set of levers comprise a first parallelogram. Third and fourth levers are connected to the mid-frame. The fourth lever has an arm with an interface. These levers are connected with a drag link. An actuator can be pivotally and movably connected to the interface and pivotally connected to the drag link. The location of the actuator relative the interface is controlled with a control arm. The bases, mid-frame and second set of levers comprise a second parallelogram.

7 Claims, 11 Drawing Sheets

HEIGHT ADJUSTABLE APPARATUS

This application is a continuation-in-part of U.S. Utility application having Ser. No. 11/173,491 filed on Jun. 30, 2005, now U.S. Pat. No. 7,421,748 the contents of which are hereby incorporated herein by reference.

This application claims priority on U.S. Provisional Application having Ser. No. 60/877,248 filed on Dec. 26, 2006, the contents of which are hereby incorporated herein by reference.

BACKGROUND OF THE INVENTION

1. Field of the Invention

The present invention relates to an apparatus, such as a bed, having a vertically adjustable deck that is selectably raised and lowered with actuators operating with improved loading characteristics.

2. Description of the Related Art

Typically, height and angle adjustable beds are used by medical institutions, such as hospitals and nursing homes. The beds usually include a bed frame and an articulating mechanism for lowering the bed frame to a low position and raising the bed frame to a high position so that it may be used as a gurney or at any height in between. As a result, a patient can be transferred by merely sliding the patient from one gurney to another or a chair.

It is known to have height and angle adjustable beds that may be lowered to a fully lowered position near the floor; however, such beds usually require a mechanical or hydraulic compression assist mechanism or high-power hydraulic lift mechanisms to lift the bed from the fully lowered position. For example, U.S. Pat. No. 6,405,393 to Megown ("the '393 Patent"), the contents of which are hereby incorporated herein reference, discloses a spring assist mechanism that allows a height adjustable bed to raise from a fully lowered position. The '393 Patent describes the increase in force necessary to raise the bed from the fully lowered position. This is because as the angle between the linear actuator and the bed frame in the bed shown in the '393 patent approaches zero, the cosine of that angle also approaches zero. As the cosine of the angle approaches zero, the resultant lift component, or vertical component, of the actuator force also approaches zero. The actuator is therefore at a mechanical disadvantage when the cosine of the angle approaches zero. A mechanical or hydraulic compressive assist mechanism may be used to overcome the mechanical disadvantage. However, such components may fail unexpectedly. In addition, when such mechanisms fail, time delay, damage or injury may occur. Thus, it would be desirable to eliminate any need for mechanical and hydraulic compressive assist mechanisms.

A further disadvantage of some existing angle adjustable beds is that they comprise two motors acting in parallel. The additional force of multiple motors acting in parallel can be useful for overcoming the mechanical disadvantage created at the low positions. Yet, use of two motors in parallel can be disadvantageous as the two motors can get out of synchronization. In this regard, either motor may raise or lower a respective end of the bed at a different rate. This could jeopardize the health and safety of any person on the bed. Further, such a drawback could make transport during raising and lowering of the bed impractical and hazardous. Further, while having two motors acting in parallel may be beneficial in overcoming the mechanical disadvantage at the low position, their use can be inefficient.

A still further disadvantage yet of existing angle adjustable beds is that they may require an undesirably large amount of swing to reposition the bed from the lowered position to the raised position. The swing occurs as a result of the support frame of the bed moving forward or rearward relative to the wheels. A large swing is disadvantageous for several reasons. First, having bed frame move forward or rearward relative to the wheels changes the center of gravity of the bed. The larger the swing, the larger the change in the center of gravity of the bed. Second, with the ever increasing pressure to reduce room size and to fit more items into existing rooms, there is a sizable disadvantage to a bed that requires a relatively large amount of swing to raise the bed to the raised position.

A still further disadvantage yet of some existing beds is that they are relatively slow to raise the bed from a lowered position to a raised position.

Thus there exists a need for an apparatus such as a bed that solves these and other problems.

SUMMARY OF THE INVENTION

The present invention relates to an apparatus, such as a bed, having a vertically adjustable deck that is selectably raised and lowered with actuators operating with improved loading characteristics.

In a preferred embodiment, the invention has a main-frame and a deck, hereafter referred to collectively as a deck, and a mid-frame. The deck and mid-frame are connected by first set of levers having a first lever and a second lever. The first lever can have three arms, and can have an interface such as a track, slide or slot in the third arm. The first and second levers can be connected with a drag link. An actuator can be pivotally and slideably or movably connected to the first lever, in the interface, and pivotally connected to the drag link. In this regard, the actuator is pivotally connected relative to but not directly to both the mid-frame and the deck. The location of the actuator relative the interface is controlled with a control arm. Movement of the actuator relative the interface can change the effective length of the third arm of the first lever. The deck, mid-frame and first set of levers comprise a first parallelogram.

A second set of levers, comprising third lever and fourth lever, is further connected to the mid-frame. The fourth lever can have three arms, and can have an interface such as a track, slide or slot in the third arm. The third and fourth levers can be connected with a drag link. An actuator can be pivotally and slideably or movably connected to the fourth lever, at the interface, and pivotally connected to the drag link. In this regard, the actuator is pivotally connected relative to but not directly to both the mid-frame and the castor bases. The location of the actuator relative the interface is controlled with a control arm. Movement of the actuator relative the interface can change the effective length of the third arm of the fourth lever. The bases, mid-frame and second set of levers comprise a second parallelogram. The first and second parallelograms can operate in opposite rotational directions at equal or near equal speed and in opposed and equal or near equal lateral amounts so that the net effect is a vertical or near vertical rise and lowering of the bed.

It is appreciated that in an alternative embodiment, wherein the bed has no interfaces, the use of the mid-frame may be unnecessary.

According to an advantage of the present invention, the deck can rise in a vertical or near vertical manner. This is accomplished in a preferred embodiment by having the parallelograms extend in opposing rotational directions. The first parallelogram can rise in a counterclockwise orientation, and the second parallelogram can rise in a clockwise orientation. The extensions of the parallelograms, respectively, are preferably made at equal speed and with equal lateral travel. The actual rotations of each parallelogram can effectively cancel each other out resulting in generally vertical rise.

According to another advantage of the present invention, the deck can have a relatively fast rate of rising and lowering. This is accomplished in a preferred embodiment by having two actuators acting in series rather than parallel. A further advantage of operating in series is that if one of the actuators fails, the bed will not become unbalanced and the deck will always remain generally parallel with the floor. This reduces the risk or injury if a failure occurs.

According to a further advantage of the present invention, the actuators are operated in an improved efficiency. This is accomplished in a preferred embodiment by having the ends of the actuators move in opposed directions, and not fixed to the deck. This is further accomplished by changing the effective length of one of the arms of the levers. As the parallelograms extend, the respective control arm causes an end of the each actuator to move relative the respective interface to shorten the effective length of the third arm of the respective lever to increase the lift to stroke ratio of the actuators. The result is that the load curve of the actuators can be held relatively steady at or near peak efficiency throughout their entire respective strokes.

According to a further advantage yet of the present invention, the marginal difference in loads between the first and second actuators (due to the increase in weight of the additional components for the second actuator) can be compensated for by the design of the geometry of the interfaces, respectively. Compensating for the weight variance allows the first and second parallelograms to extend at equal rates resulting in vertical rise of the bed.

Other advantages, benefits, and features of the present invention will become apparent to those skilled in the art upon reading the detailed description of the invention and studying the drawings.

DETAILED DESCRIPTION OF THE PREFERRED EMBODIMENTS

Figure 1:
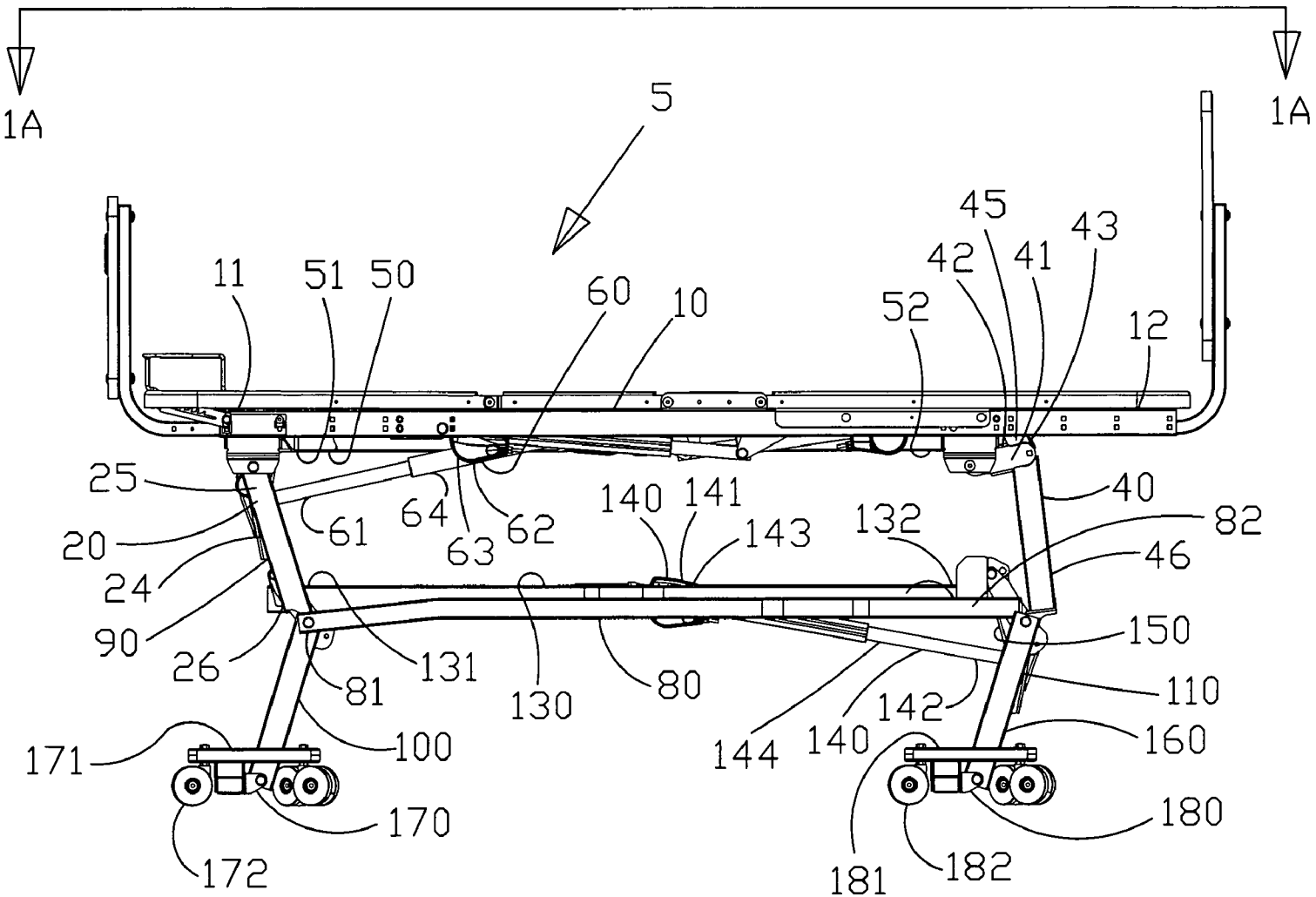
FIG. 1 is a side view of a preferred embodiment of the present invention in a high position.
Figure 1A:
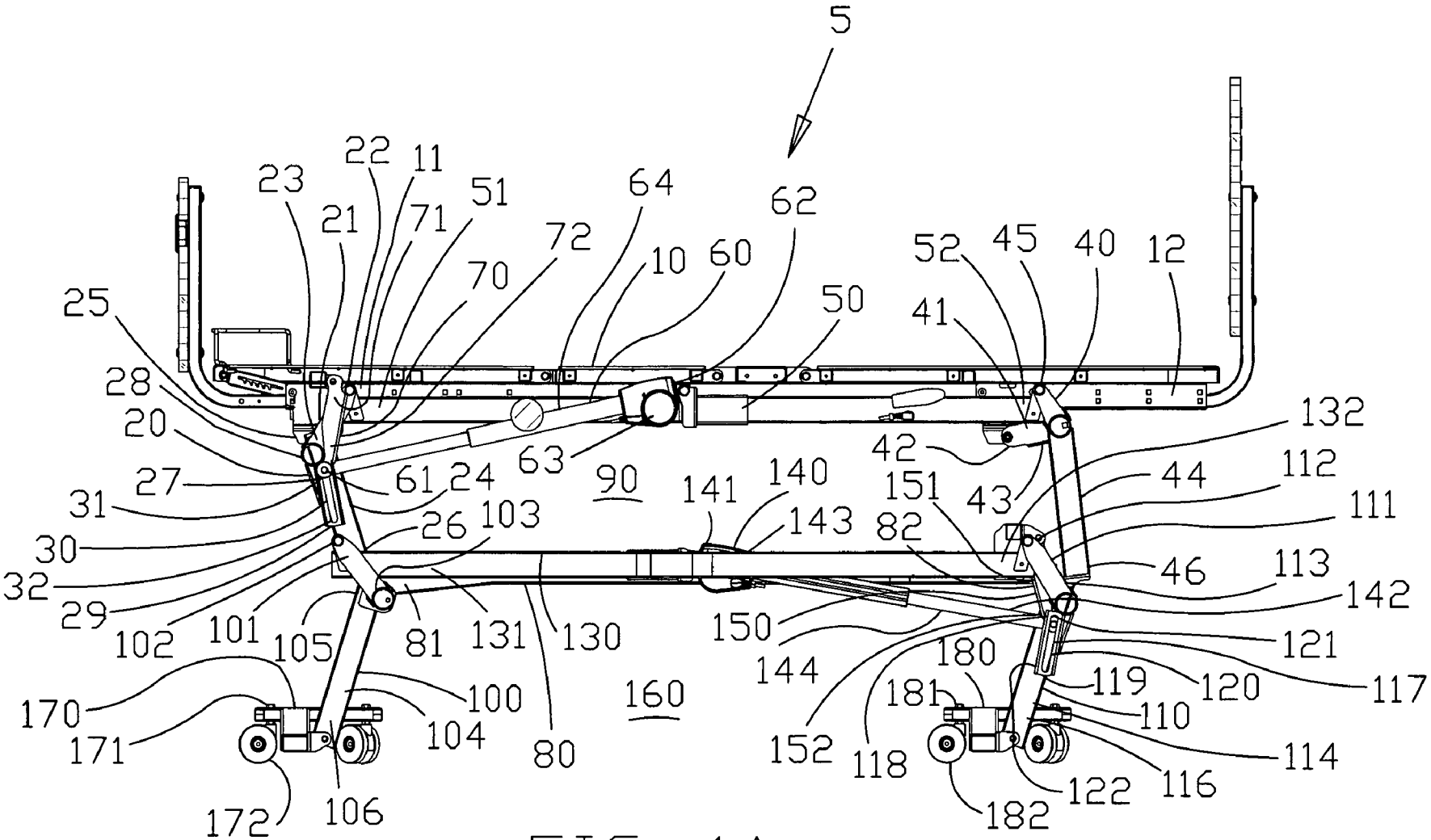
FIG. 1A is a section side view of the preferred embodiment shown in FIG. 1.
Figure 2:
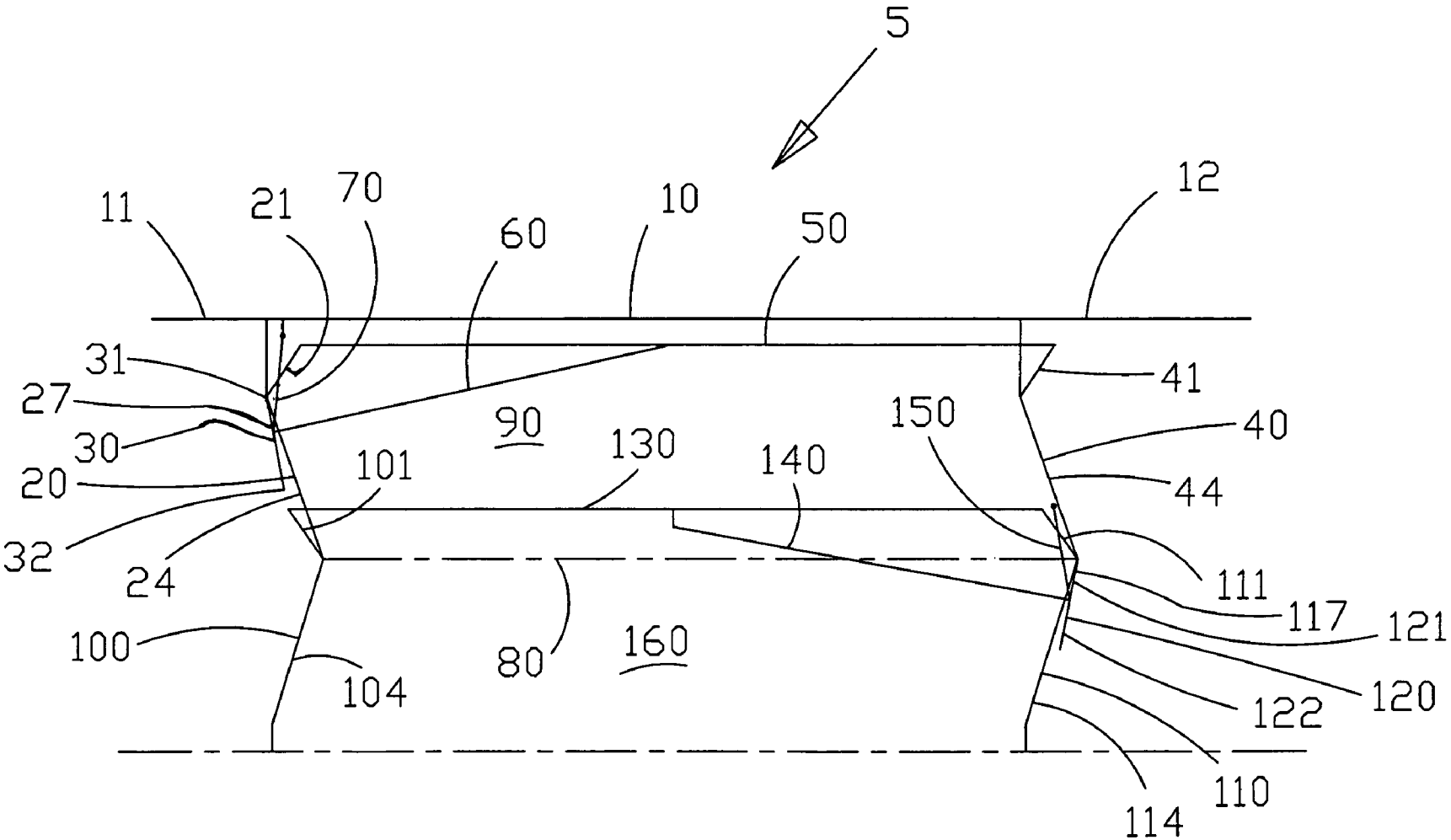
FIG. 2 is a schematic view of a preferred embodiment of the present invention in a high position.
Figure 3:
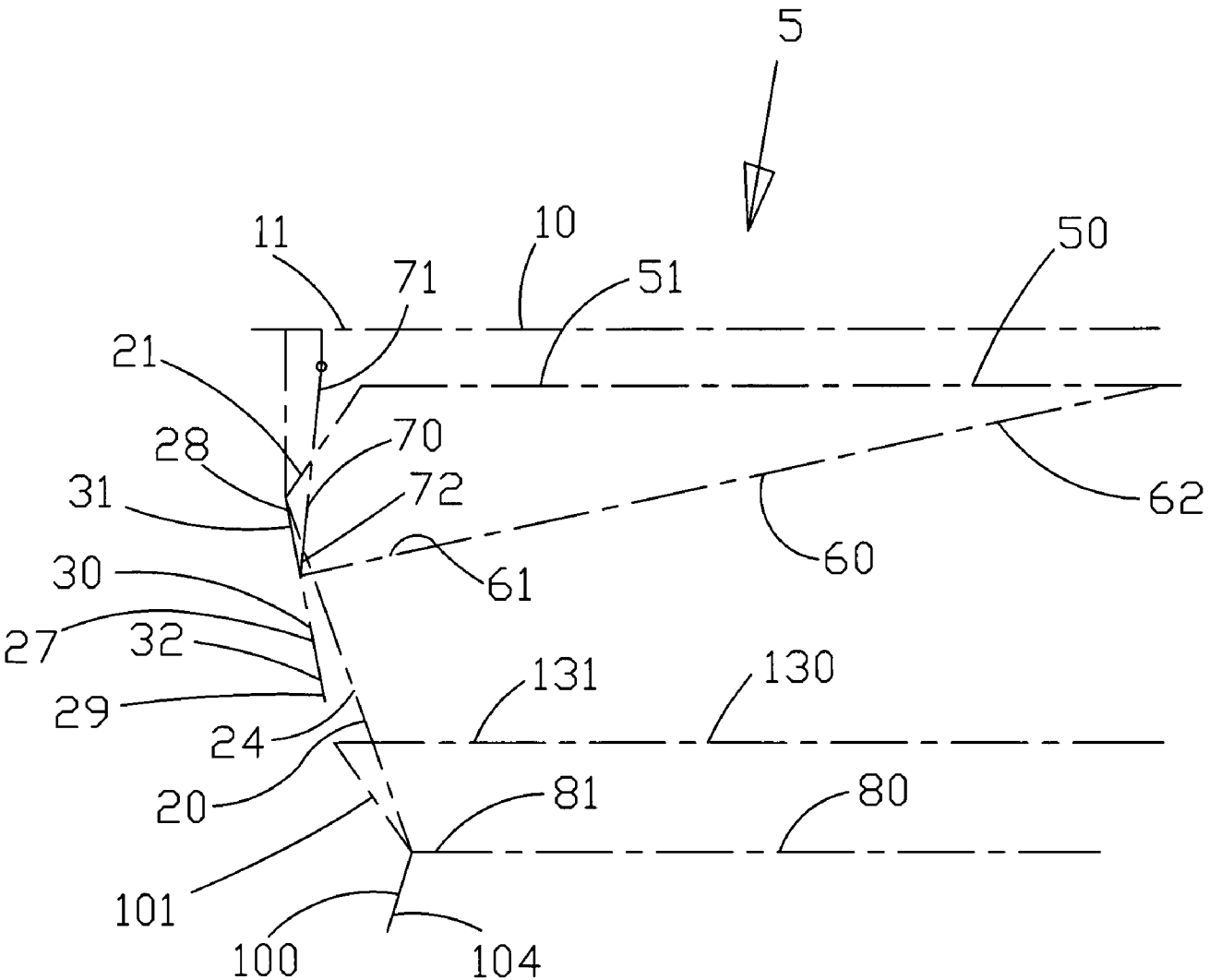
FIG. 3 is a close-up view of a portion of FIG. 2.

While the invention will be described in connection with several preferred embodiments, it will be understood that it is not intended to limit the invention to those embodiments. On the contrary, it is intended to cover all alternatives, modifications and equivalents as may be included within the spirit and scope of the invention as defined by the appended claims.

A bed 5 is provided according to the present invention as shown in FIGS. 1-10. The bed 5 has a main-frame and deck, hereafter referred to collectively as a deck 10. The deck 10 has a first end 11 and a second end 12.

A first lever 20 is preferably at the first end 11 of the deck 10. The first lever 20 has arms 21, 24 and 27. The arms 21, 24 and 27 are rigidly connected to a cross-beam. The arms 21, 24 and 27 rotate about a central axis at the same rate. The cross-beam need not be concentric with the central axis. Arm 21 has a first end 22 and a second end 23. Arm 24 has a first end 25 and a second end 26. Arm 27 has a first end 28 and a second end 29. Arm 27 further has an interface or path formed therein. One preferred interface is a track 30 or slide or slot. It is appreciated that other interfaces, such as a cam and follower could be used without departing from the broad aspects of the present invention. Track 30 has a first end 31 and a second end 32. Track 30 can be straight or curved. The first end 25 of arm 24, or deck arm 24, is preferably pivotally connected to the deck 10.

A second lever 40 is preferably at the second end 12 of the deck 10. The second lever 40 has arms 41 and 44. Arms 41 and 44 are rigidly connected to a cross-beam. The arms 41 and 44 rotate about a central axis at the same rate. The cross-beam and central axis need not be concentric. Arm 41 has a first end 42 and a second end 43. Arm 44 has a first end 45 and a second end 46. Arm 44, or deck arm 44, connects to the deck 10.

A drag link 50 is provided for connecting the first lever 20 and the second lever 40. The drag 50 has a first end 51 and an opposed second end 52. The first end 51 of the drag link 50 is pivotally connected to the first end 22 of arm 21, or drag link arm 21. The second end 52 of the drag link 50 is pivotally connected to the first end 42 of arm 41, or drag link arm 41.

Figure 4:
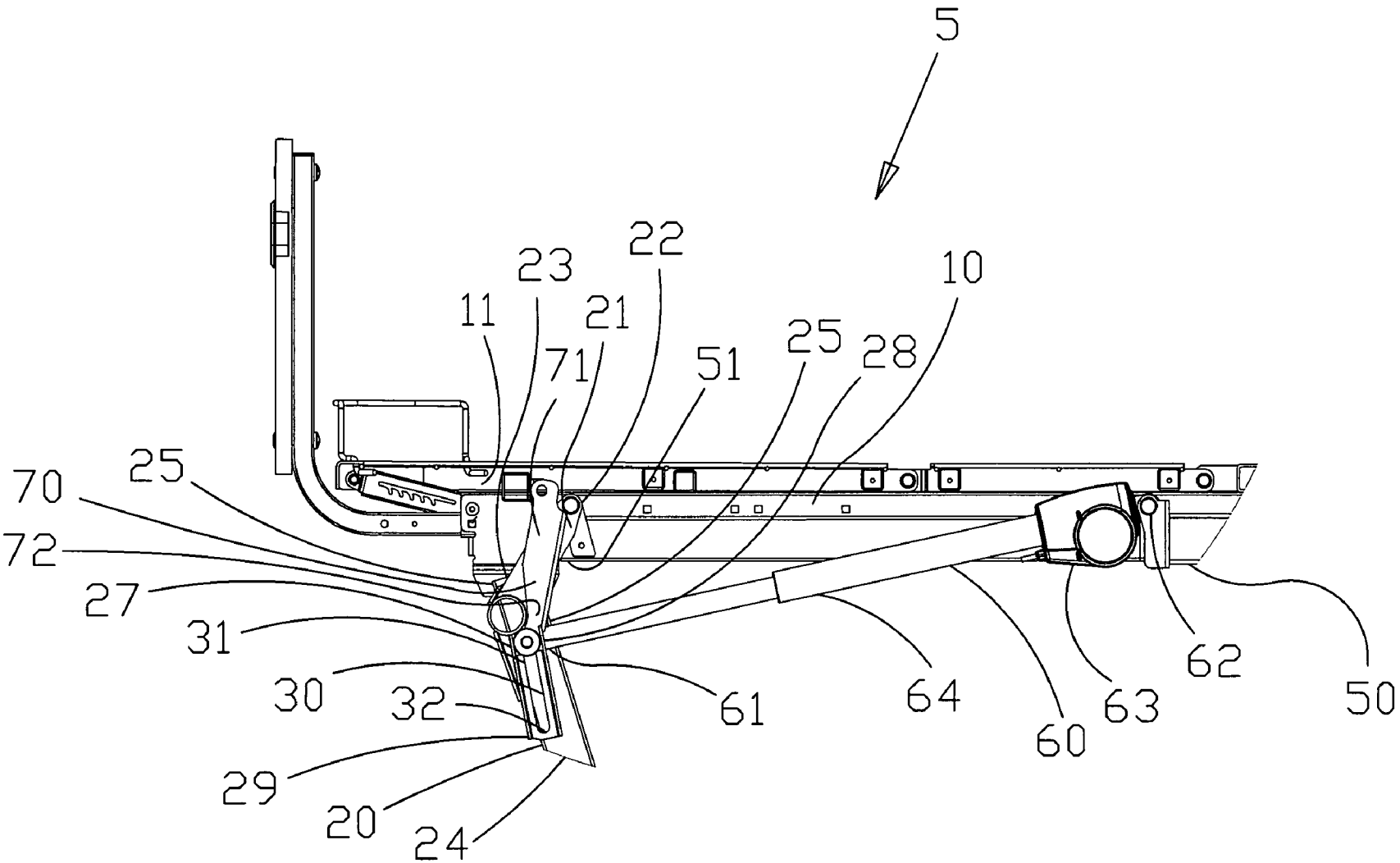
FIG. 4 is a side section view of a portion of the present invention in a high position.
Figure 5:
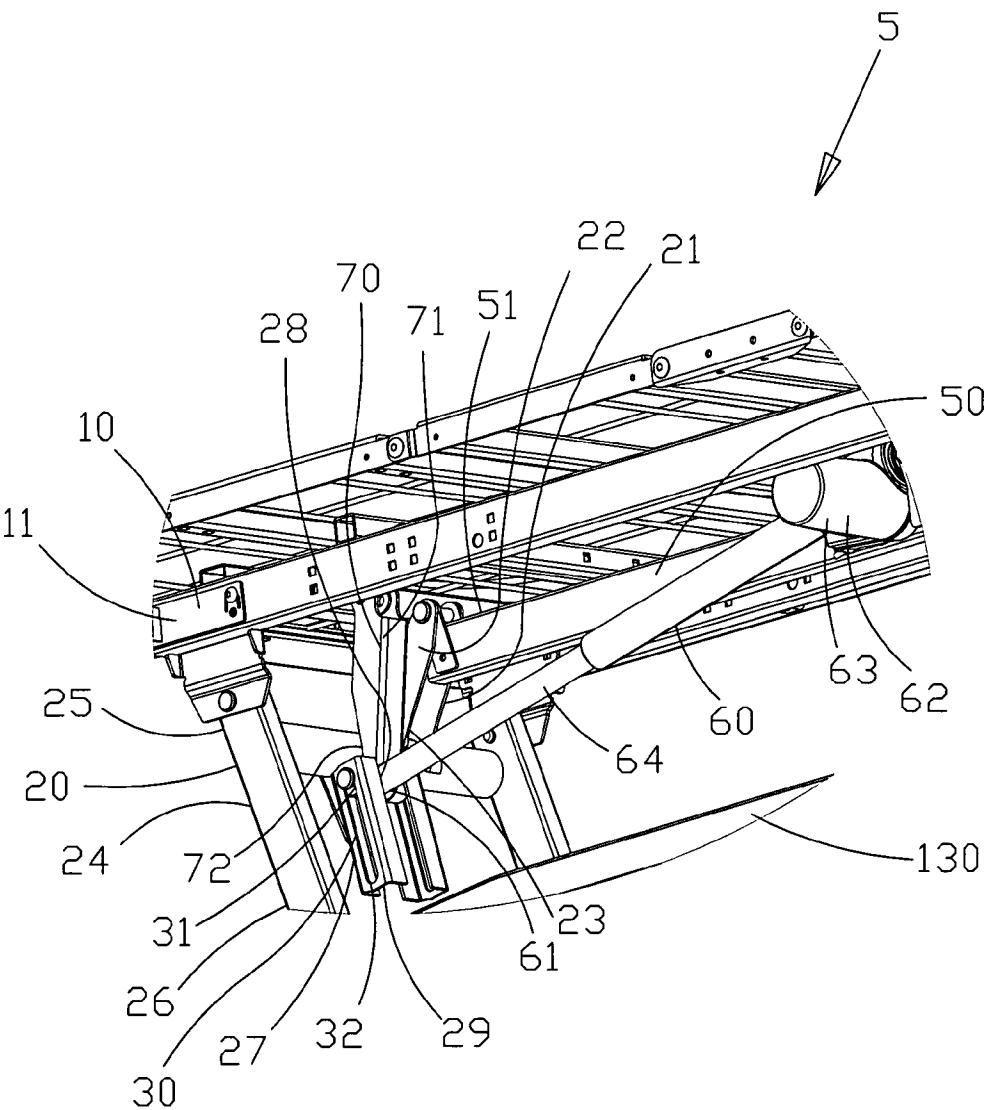
FIG. 5 is a perspective view of the view shown in FIG. 4.

An actuator 60 is further provided. The actuator has a first end 61 and a second end 62. The actuator 60 further has a motor 63 and a linear shaft 64. In the preferred embodiment, the actuator 60 is an electrically powered actuator. The motor 63 is at the second end 62 of the actuator 60, and can be pivotally connected to the drag link 50 at a point intermediate the ends 51 and 52. The first end 61 of the actuator 60 is preferably pivotally connected to arm 27, or interface arm 27, of the lever. Further, the first end 61 of the actuator is slideably or movably received within track 30 between the first end 31 and second end 32. As shown in FIGS. 4 and 5, a roller can be provided for co-acting with the interface. Such is a preferred embodiment. Yet, it is understood that other embodiments can be utilized without departing from the broad aspects of the present invention. It is further understood that while the actuator 60 is shown in one orientation relative the drag link 50 and arm 27, that the opposite orientation (motor 63 near arm 27) could be utilized without departing from the broad aspects of the present invention.

A control arm 70 is provided. The control arm has a first end 71 and a second end 72. The first end 71 is pivotally connected to the deck 10. The second end 72 is pivotally connected to end 61 of the actuator 60. The control arm 70 controls the location of the end 61 of the actuator 60 within the track 30.

A mid-frame 80 is further provided having a first end 81 and a second end 82. The second end 26 of arm 24 is pivotally connected to the first end 81 of the mid-frame 80. The second end 46 of arm 44 is pivotally connected to the second end 82 of the mid-frame 80.

The deck 10, lever 20, lever 40 and mid-frame 80 comprise a first parallelogram 90. The parallelogram is preferably comprised of theoretical lines drawn between connection points of the components, and not necessary comprised of the structure of the components themselves, respectively. The parallelogram 90 expands as the bed rises in a clockwise rotation, and collapses as the bed collapses in a counter-clockwise rotation. The deck 10 and mid-frame 80 remain generally parallel during the expansion and collapse of parallelogram 90.

Figure 9:
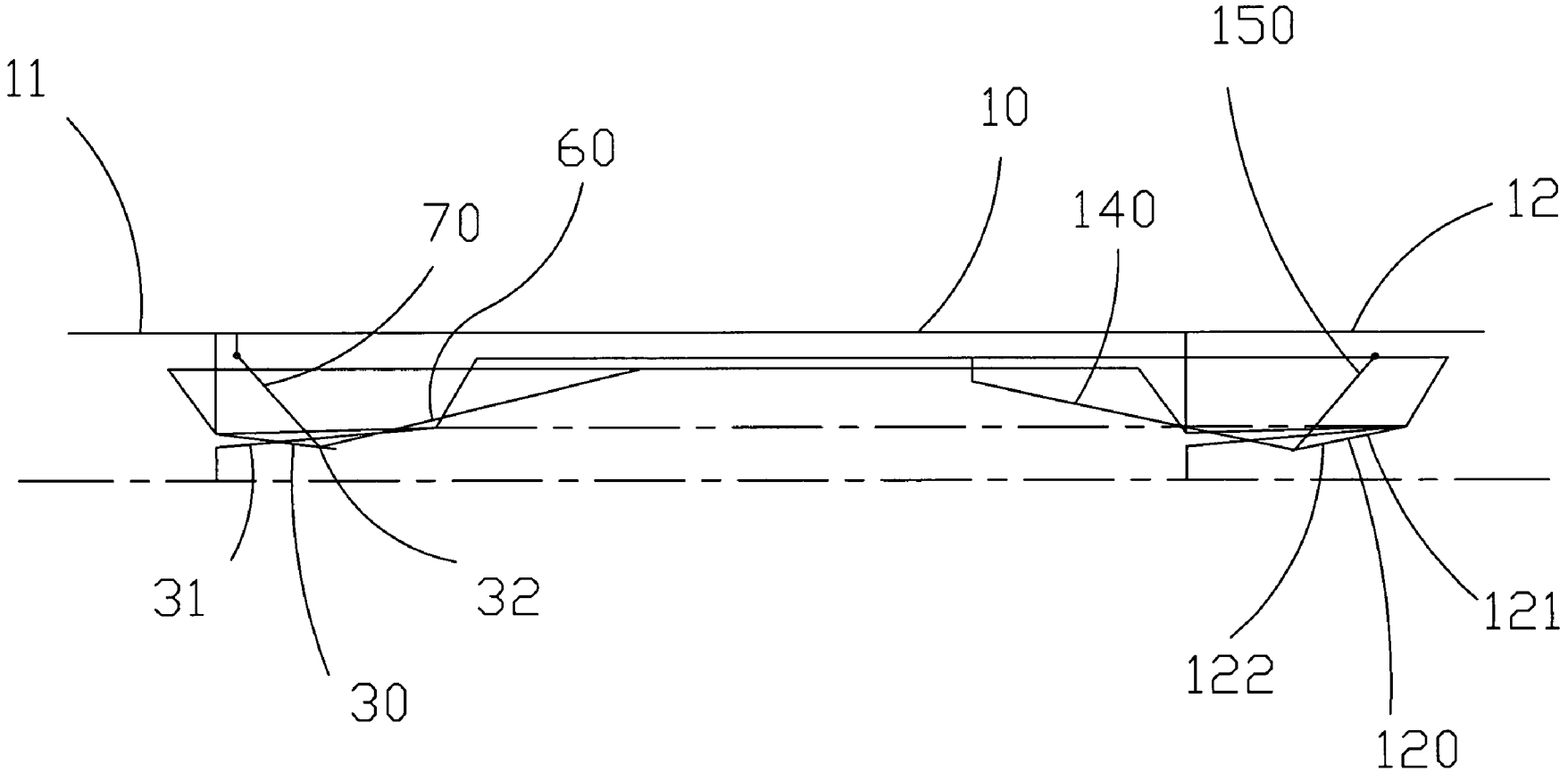
FIG. 9 is a schematic view of the preferred embodiment of the present invention shown in a low position.
Figure 10:
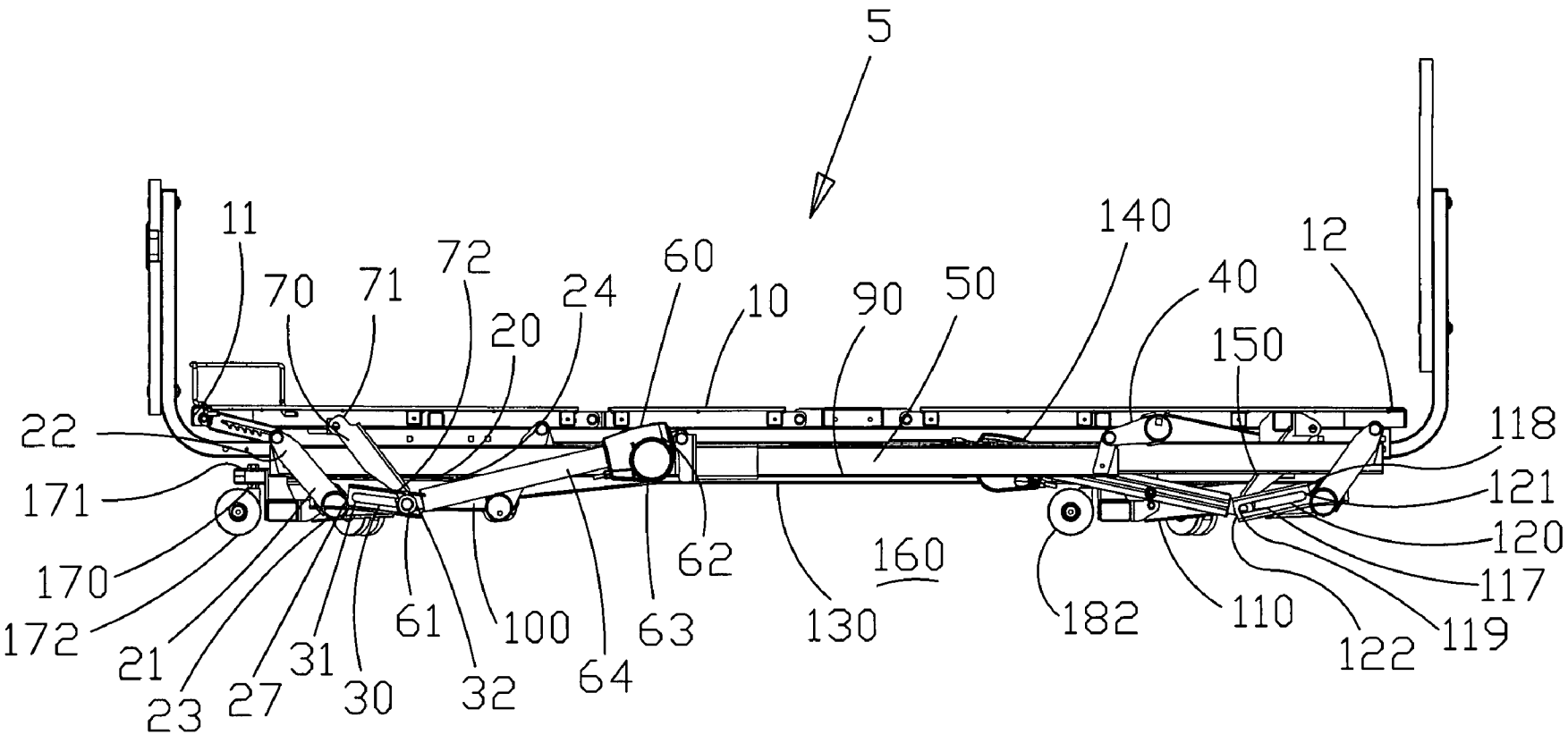
FIG. 10 is a section view of the preferred embodiment of the present invention shown in a low position.

When the bed is collapsed, or in the low position, as shown in FIGS. 9 and 10, the control arm 70 dictates that the first end 61 of the actuator 60 be positioned at the second end 32 of the track 30. In this position, the effective length of arm 27 is maximized. The length of the arm 27 determines the ratio of lift in the bed 5 relative stroke of the actuator 60. At the low position, a large amount of force is required to lift the bed 5 a small amount. The large effective length allows for a relatively large amount of torque to be created. A maximum effective length is therefore desirable so that the actuator 60 can act at or near peak efficiency.

Figure 6:
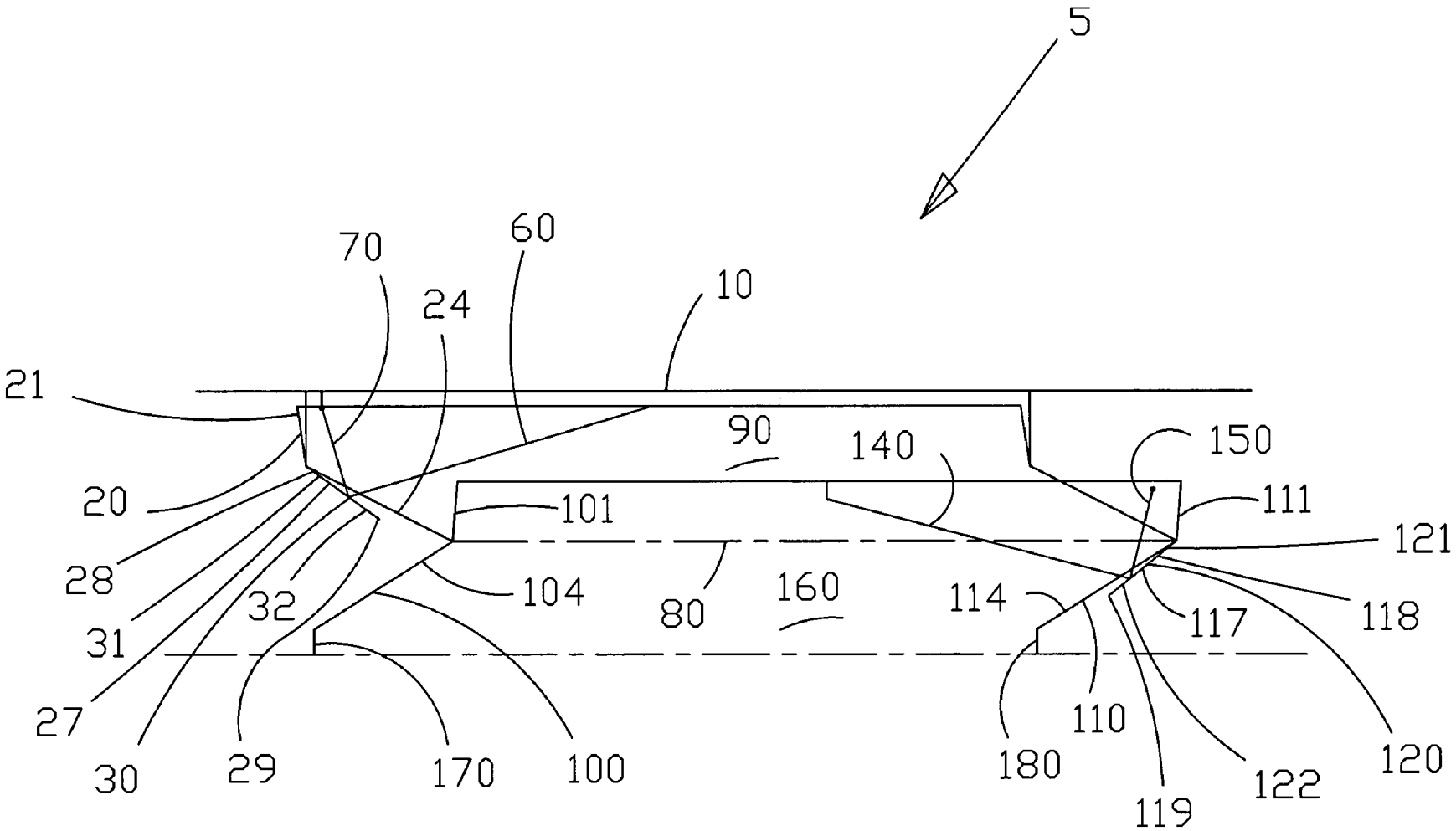
FIG. 6 is a schematic view of the preferred embodiment of the present invention shown in a mid-high position.
Figure 7:
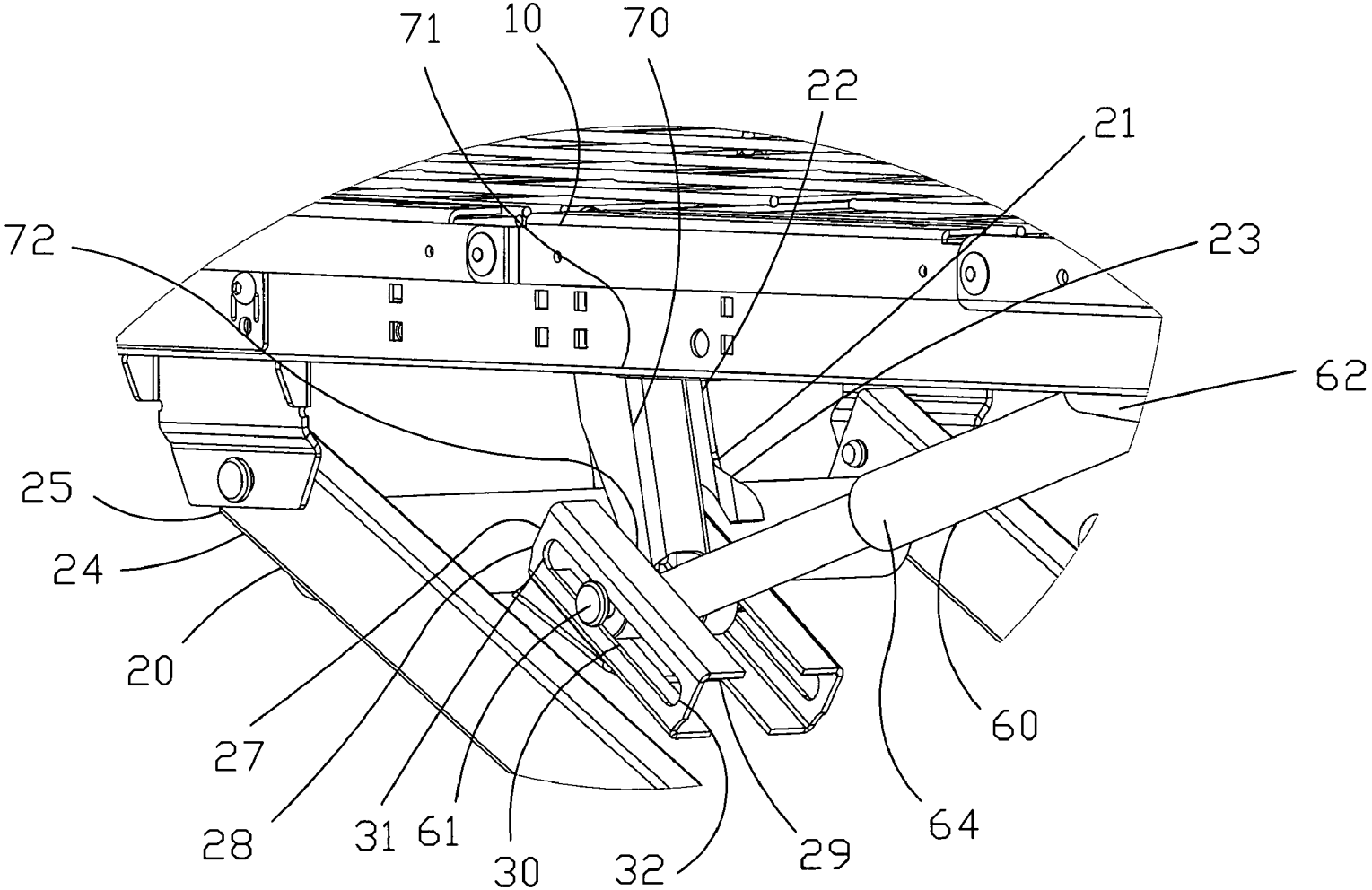
FIG. 7 is a partial perspective view of the preferred embodiment of the present invention shown in a mid-high position.
Figure 8:
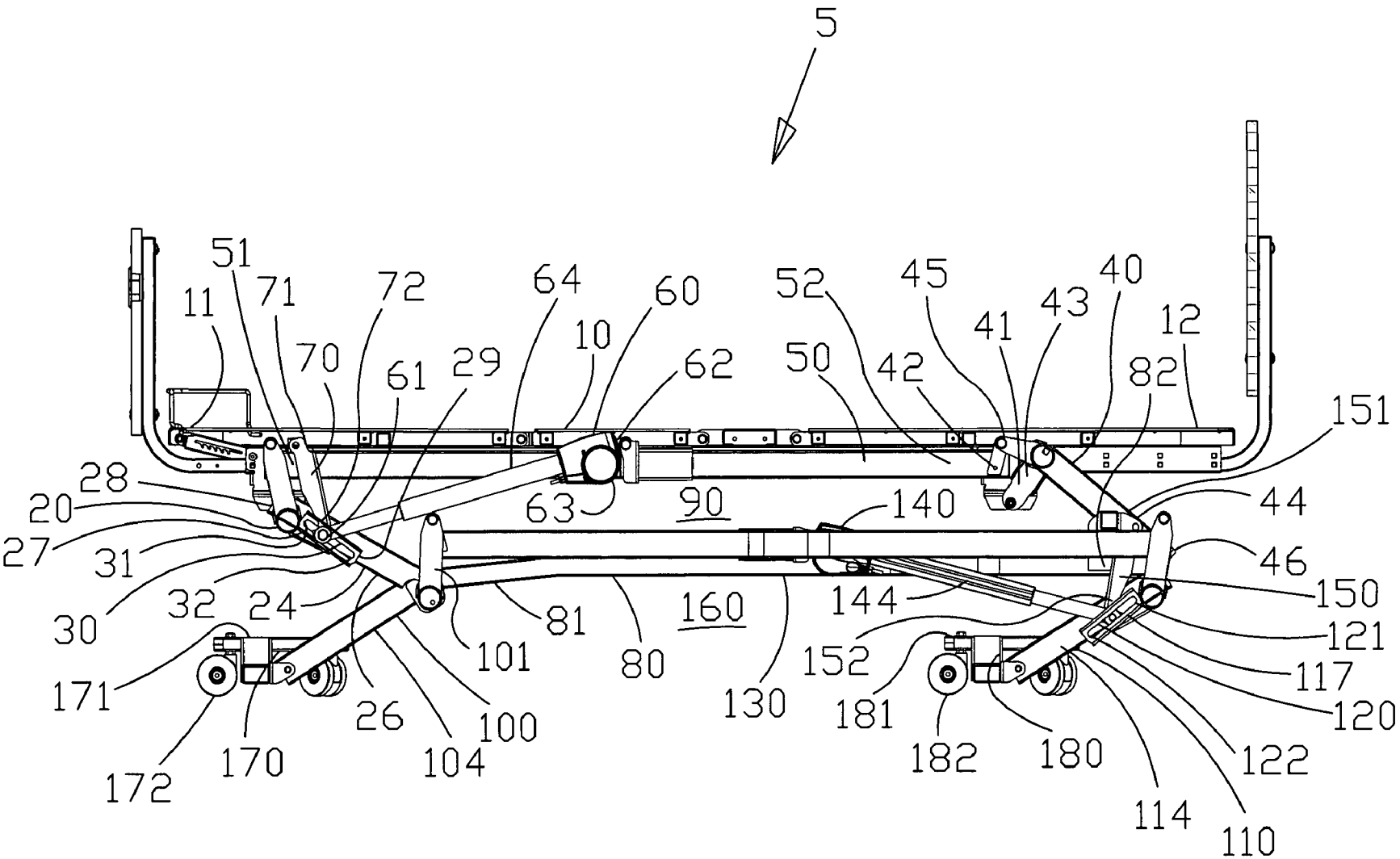
FIG. 8 is a section side view of the preferred embodiment of the present invention shown in a mid-high position.

The bed 5 is shown in a mid position in FIGS. 6-8. While the bed 5 is rising, the first end 61 of the actuator 60 slides in the track 30 away from end 32 and towards end 31. This shortens the effective length of arm 27 to increase the ratio of lift to stroke, and increase the speed of rotation of arms 21, 24 and 27 about the central axis. Increasing the ratio of lift to stroke maintains the output of the actuator near its peak capacity, and hence utilizes the actuator at or near peak efficiency.

The first end 61 of the actuator approaches the first end 31 of the track as the bed 5 reaches the high position (and when the parallelogram 90 is fully extended). The high position of the bed 5 is shown in FIGS. 1-5.

It is appreciated that since the actuator 60 is connected to drag link 50, it is not directly connected to or fixed to the deck 10. Further, since the actuator is connected to arm 27, it is not directly connected to or fixed to the mid-frame 80. Accordingly, the actuator 60 is a floating actuator.

It is also appreciated that the first end 61 of the actuator 60 can preferably continuously slide with track 30 as the bed 5 is being raised or lowered. It is possible, but not required that the first end 61 of the actuator 60 slide within the track 30 at a constant rate.

A third lever 100 is further provided. The third lever 100 has arms 101 and 104. Arms 101 and 104 are rigidly connected to a cross-beam. The arms 101 and 104 rotate about a central axis at the same rate. The cross-beam need not be concentric with the central axis. Arm 101 has a first end 102 and a second end 103. Arm 104 has a first end 105 and a second end 106. Arm 104, or mid-frame arm 104, pivotally connects to the mid-frame 80 near the first end 81.

A fourth lever 110 is preferably at the second end 82 of the mid-frame 80. The fourth lever 110 has arms 111, 114 and 117. The arms 111, 114 and 117 are rigidly connected to a cross-beam. The arms 111, 114 and 117 all rotate about a central axis at the same rate. The cross-beam and central axis need not be concentric. Arm 111 has a first end 112 and a second end 113. Arm 114 has a first end 115 and a second end 116. Arm 117 has a first end 118 and a second end 119. Arm 117 further has an interface or path formed therein. One preferred interface is a track 120, or slide or slot. It is appreciated that other interfaces, such as a cam and follower may be used without departing from the broad aspects of the present invention. Track 120 has a first end 121 and a second end 122. Track 120 can be straight or curved. The first end 115 of arm 114, or mid-frame arm 114, is preferably pivotally connected to the second end 82 of the mid-frame 80.

A drag link 130 is provided for connecting the third lever 100 and the fourth lever 110. The drag 130 has a first end 131 and an opposed second end 132. The first end 131 of the drag link 130 is pivotally connected to the first end 102 of arm 101, or drag link arm 101. The second end 132 of the drag link 130 is pivotally connected to the first end 112 of arm 111, or drag link arm 111.

An actuator 140 is further provided. The actuator has a first end 141 and a second end 142. The actuator 140 further has a motor 143 and a linear shaft 144. In the preferred embodiment, the actuator 140 is an electrically powered actuator. The motor 143 is at the second end 142 of the actuator 140, and can be pivotally connected to the drag link 130 at a point intermediate the ends 131 and 132. The first end 141 of the actuator 140 is preferably pivotally and slideably or movably connected to arm 117, or interface arm 117, of the lever 110. The first end 141 of the actuator 140 is slideably received within track 120 between the first end 121 and second end 122.

A control arm 150 is provided. The control arm has a first end 151 and a second end 152. The first end 151 is pivotally connected to the mid-frame 80. The second end 152 is pivotally connected to end 141 of the actuator 140. The control arm 150 controls the location of the end 141 of the actuator 140 within the track 120.

A first castor base 170 is provided having a deck 171 and castors 172. The first castor base is pivotally connected to the second end 106 of arm 104.

A second castor base 180 is further provided having a deck 181 and castors 182. The second castor base 180 is pivotally connected to the second end 116 of arm 114.

The mid-frame 80, lever 100, lever 110, castor base 170 and castor base 180 comprise a second parallelogram 160. The parallelogram is preferably comprised of theoretical lines drawn between connection points of the components, and not necessary comprised of the structure of the components themselves, respectively. The parallelogram 160 expands as the bed 5 rises in a counter-clockwise rotation, and collapses as the bed collapses in a clockwise rotation. The mid-frame 80 remains generally parallel to the floor during expansion and collapse of the parallelogram 160.

When the bed is collapsed, or in the low position, as shown in FIGS. 9 and 10, the control arm 150 dictates that the first end 141 of the actuator 140 be positioned at the second end 122 of the track 120. In this position, the effective length of arm 117 is maximized. The length of the arm 117 determines the ratio of lift in the bed 5 relative stroke of the actuator 140. At the low position, a large amount of force is required to lift the bed 5 a small amount. The large effective length allows for a large amount of torque to be created. A maximum effective length is therefore desirable so that the actuator 140 operates at or near peak efficiency.

While the bed 5 is rising, the first end 141 of the actuator 140 slides in the track 120 away from end 122 and towards end 121. This shortens the effective length of arm 117 to increase the ratio of lift to stroke, and increase the rotational speed of the arms 111, 114 and 117 about the central axis. Increasing the ratio of lift to stroke maintains force output of the actuator 140 near its peak capacity, and hence utilizes the actuator at or near peak efficiency.

The first end 141 of the actuator approaches the first end 118 of the track as the bed 5 reaches the high position (and when the parallelogram 160 is fully extended).

It is appreciated that since actuator 140 is connected to the drag link 130, it is not directly connected or fixed to the mid-frame 80. Further, since the actuator 140 is connected to arm 117, it is not directly connected or fixed to either castor base 170 or 180. Accordingly, the actuator 140 is a floating actuator. It is further understood that while the actuator 140 is shown in one orientation relative the drag link 130 and arm 117, that the opposite orientation (motor 143 near arm 117) could be utilized without departing from the broad aspects of the present invention.

It is also appreciated that the first end 141 of the actuator 140 can preferably continuously slide with track 120 as the bed 5 is being raised or lowered. It is possible, but not required that the first end 141 of the actuator 140 slide within the track 120 at a constant rate.

The first parallelogram 90 rotates opposite the second parallelogram 160. In this regard, the overall lift of the bed 5 is generally vertical. This is because the actual swing of parallelogram 90 cancels out or opposes the relative swing of parallelogram 160. The opposed swings of the first and second parallelograms 90 and 160, respectively, occur at approximately an equal rate. Accordingly, the deck 10 remains parallel to the mid-frame 80, which remains parallel to the floor at all positions of the bed 5.

It is also noted that actuators 60 and 140 act in series rather than in parallel. Actuator 60 extends parallelogram 90 and actuator 140 extends parallelogram 160.

It is further appreciated that the mid-frame 80 is useful when accompanied by use of interfaces such as tracks. The use of a mid-frame may be unnecessary in embodiments where no interfaces are utilized.

Thus it is apparent that there has been provided, in accordance with the invention, a height adjustable apparatus that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A height adjustable apparatus comprising:

a deck;

a first lever, said first lever comprising:

a first lever deck arm connected to and supporting said deck; and a first lever interface arm having a first lever interface arm first end, a first lever interface arm second end and an interface between said first lever interface arm first end and said first lever interface arm second end, wherein the distance between said first lever interface arm first end and a variable point relative said interface defines a first lever interface arm effective length, wherein said first lever deck arm and said first lever interface arm are stationary relative each other;

a second lever, said second lever comprising a second lever deck arm connected to and supporting said deck; and an actuator having an actuator first end and an actuator second end, wherein one of said actuator first end and said actuator second end is movably and pivotally connected to said first lever interface arm at said interface, and wherein movement of said one of said actuator first end and said actuator second end relative said interface controls said effective length of said first lever interface arm.

2. The height adjustable apparatus of claim 1 wherein said interface is a slot, said slot having a first end and a second end.

3. The height adjustable apparatus of claim 1 wherein said interface allows for linear movement of said one of said actuator first end and said actuator second end relative said interface.

4. The height adjustable apparatus of claim 1 further comprising a control arm, said control arm having a control arm first end and a control arm second end, one of said control arm first end and said control arm second end being pivotally connected to said deck, and the other of said control arm first end and said control arm second end controlling the location of said one of said actuator first end and said actuator second end relative said interface.

5. A height adjustable apparatus comprising:

a structure that is selectably moved up and down;

a first lever, said first lever comprising:

a first lever structure arm connected to and supporting said structure; and a first lever interface arm having a first lever interface arm first end, a first lever interface arm second end and an interface between said first lever interface arm first end and said first lever interface arm second end, wherein the distance between said first lever interface arm first end and a variable point relative said interface defines a first lever interface arm effective length, wherein said first lever structure arm and said first lever interface arm are stationary relative each other and rotate about a first lever rotation point;

a second lever, said second lever comprising a second lever structure arm connected to and supporting said structure; and an actuator having an actuator first end and an actuator second end, wherein one of said actuator first end and said actuator second end is movably and pivotally connected to said first lever interface arm at said interface, and wherein movement of said one of said actuator first end and said actuator second end relative said interface controls said effective length of said first lever interface arm.

6. The height adjustable apparatus of claim 5 further comprising a control arm, said control arm having a control arm first end and a control arm second end, one of said control arm first end and said control arm second end being pivotally connected to said structure, and the other of said control arm first end and said control arm second end controlling the location of said one of said actuator first end and said actuator second end relative said interface.

7. The height adjustable apparatus of claim 6 wherein said one of said control arm first end and said control arm second end that is pivotally connected to said structure is pivotally connected to said structure at a fixed distance from said first lever rotation point.

* * * * *